US005685095A

United States Patent [19]

DeMasi

[11] Patent Number: 5,685,095

[45] Date of Patent: Nov. 11, 1997

[54] SKI LIFT CHAIR MAP

[76] Inventor: Peter DeMasi, 19 First Ave., Montpelier, Vt. 05602

[21] Appl. No.: 613,807

[22] Filed: Mar. 6, 1996

[51] Int. Cl.[6] ..... G09F 3/18

[52] U.S. Cl. ..... 40/320; 40/904; 297/488

[58] Field of Search ..... 40/316, 320, 904, 40/586, 308; 297/488

[56] References Cited

U.S. PATENT DOCUMENTS

| | | | |
|---|---|---|---|
| 4,164,910 | 8/1979 | Feiler | 40/586 X |
| 4,513,983 | 4/1985 | Calder | 40/308 X |
| 4,636,271 | 1/1987 | Gandolfo | 40/316 X |
| 4,876,810 | 10/1989 | Piana et al. | 40/316 |
| 5,183,193 | 2/1993 | Brandell | 40/904 X |
| 5,400,936 | 3/1995 | Jones et al. | 40/904 X |
| 5,425,546 | 6/1995 | Gerer et al. | 40/308 X |
| 5,477,633 | 12/1995 | Leinberger | 40/586 X |
| 5,511,850 | 4/1996 | Coursey | 297/488 X |
| 5,556,162 | 9/1996 | Raffini | 297/488 X |

*Primary Examiner*—Joanne Silbermann
*Attorney, Agent, or Firm*—Joseph B. Taphorn

[57] ABSTRACT

The safety guard of a ski lift chair is provided with a rotatable cylinder which bears a ski trail map on its periphery. The cylinder, formed of foam, is slit radially on one side from a central hole rotatably mounting it on the cross-bar of the safety guard having a pull-down position in front of the seated skier. The trail map is on a sheet longer than the periphery of the cylinder and has it ends tucked into the cylinder slit to hold the map sheet in place. The cylinder can be rotated by the gloved skier to view the full length of the trails leading from the top of the particular ski lift. It may also be slid laterally on the cross-bar for viewing by other passengers.

18 Claims, 2 Drawing Sheets

SKI LIFT CHAIR MAP

FIELD OF THE INVENTION

This invention relates to ski lift chairs, and more particularly to ski lift chairs having safety bars that are pulled-down into place by a skier after loading onto the ski lift chair.

BACKGROUND OF THE INVENTION

A common problem among skiers is unfamiliarity with many of the slopes or trails available at ski resorts. There results a need to consult trail maps while either on a chair lift or on a slope. Although ski resorts typically provide at no charge or at a nominal price maps identifying each slope or trail and its various branches and intersections, skiers encounter a major inconvenience and/or a potential hazard when using them while on the slope. For instance, when they approach a fork in the trail, they may need to stop and remove their gloves, pull a folded map out from a pocket, read the map, fold up the map, insert it in the pocket, and then put on their gloves before continuing down the slope.

Manipulating a standard map while wearing ski gloves is virtually impossible, but removal of the gloves for even brief periods of time produces significant discomfort and possible danger to the skier due to exposure of the skin to frostbite.

Additionally, skiers forced to stop on a ski slope to review their map essentially become obstacles for other skiers coming down the hill behind them. This dangerous scenario puts at risk not only the skier who is stopped on the trail, but also all skiers up-hill from him or her.

Moreover, some skiers get lost in ski areas with multiple ski lifts because they don't have a trail map with them and forget what they saw earlier back at the ski lodge. 3. PRIOR ART Ski lift chairs having pull down safety bars are well known. Typically the safety bar is pivoted on the back of the ski chair and left in the raised position by the previous occupants when they got off of the chair at the top of the ski lift. When the new occupants load onto the returned chair at the bottom of the lift, they seat themselves on the chair oncoming from behind. A new occupant then pulls the pivoted safety bar down to a position across the front of them to secure them in place during the ride up the mountain.

Earlier modifications of ski lift chairs are represented by U.S. Pat. No. Des. 249,195 (Winckler), and U.S. Pat. No. 3,729,225 (Savage). Winckler mentions attaching a visual display holder on the safety bars of ski chair equipment. Savage discloses a windshield of clear plastic sheet that is retractably mounted at its upper end across the top of a ski chair and at its lower end to a bar which may be pulled down and attached to the safety bar.

Prior efforts at providing trail maps for use by skiers included U.S. Pat. No. 4,415,106 (Connell et al); and U.S. Pat. No. 4,957,310 (Bissonnette). Connell et al attempts to overcome the frostbite problem by providing a map holder having a printed surface on a thin flexible substrate, or within a transparent sleeve, which is attached to a skier's limb and provides a view of the map without the need for the skier to remove gloves.

However the Connell et al design has several disadvantages. First, the map which may be viewed by the user upon lifting the arm and looking at the biceps area, is quite limited in size—on the order of ten or twelve square inches. For large ski areas, the information desired by most skiers simply cannot be legibly placed on such a small map area, particularly if the skier wishes to view the map through goggles or the like. Although certain major trails may be shown in this manner, the branches and intersections, along with indicia indicating the degree of difficulty, cannot easily be seen on the slopes, Second, the information content of the map is on the exterior of the map, and whether or not covered by a sleeve, is subject to the accumulation of ice, dirt, freezing rain, and other adverse elements. These adverse elements can easily cover all or portions of the map and prevent the skier from learning important information such as the branching or intersections of a particular trail.

A third disadvantage of Connell et al is the relative permanence of the attachment to the user's upper arm or other body part. The overlapping of the projecting straps so that the interlocking of the attachment means can be accomplished, requires delicate manipulation and is virtually impossible to accomplish while wearing gloves. Thus, the skier attaches the map holder while in the lodge, and is not able to remove or replace it as with the map with a map of another ski slope, without returning to the lodge or removing his gloves on the slope withn the consequent exposure of the bare hands to the elements.

Bissonnette represents another attempt to provide skiers with a trail map. His skier-worn trail map too is too small for easy reading. In an effort to compensate for this, the information content suffers.

Both the Connell et al and the Bissonnette patent designs require the skier to be pro-active before skiing. Skiers must think ahead as to which mountain they will ski, get the appropriate map, and insert it in the sleeve holder. There is an assumption in both designs that skiers will remember to "arm" themselves with the appropriate trail map when they head off to the slopes. If they forget to do this, they are confused and unaware amidst the other skiers. If they stop on the slope, they put following skiers at risk of a collision particularly since they can't be simultaneously looking at a map and out for oncoming skiers. Thus calamity can result from such an innocent moment of reading a map.

Earlier reading of an arm or pocket ski map while riding in a chair lift, is dangerous too. In addition to the inherent danger of losing one's balance and falling from the chair lift while trying to pull a trail map out of a pocket, one can easily lose a glove, pole, hat, car keys or other personal item by dropping it. What's worse, it might fall on the skier below the chair lift, injuring him. Thus skiers, both riding or skiing ones, are put in peril while a riding skier is endeavoring to read an arm or pocket trail map. As a result, skiers are disinclined to read a trail while riding, thus increasing the risk on the unfamiliar trail to both themselves and to others.

SUMMARY OF THE INVENTION

Accordingly, it is an object of the invention to provide for safer skiing.

Another object of the invention is to make for more enjoyable skiing.

A further object of the invention is to provide trail information to the skier at a convenient time and place.

Yet another object of the invention is to provide such trail information inexpensively.

An additional object of the invention is to enable the provision of trail information simply and easily.

The objects of the invention are achieved by making the trail information handily available to a skier on the lift chair transporting him up the mountain to the top of the ski trails. According to the invention, an elongated member such as a roll or cylinder is rotatably mounted on the safety bar which normally extends across a seated skier while riding up a mountain. The roll or cylinder or other elongated member would bear a trail map on its surface particularlized to the trails or slopes being serviced by the chair lift. A riding skier, with his gloves on and only using his free hand (the other holding his ski poles), would rotate the member to where the portion of the trail map of interest to him, is facing him. If the skier began his reading of the trail map at its top, he would rotate the top of the member away from him and so that he could memorize the whole trail with all of its intersections and/or selected branches.

The elongated member may also be slidably mounted on the cross-bar so that the map thereon may be individually studied by all passengers of a ski chair.

The elongated member preferrably is a preformed cylinder of insulation-type foam or the like having an axial hole of slightly greater diameter than the normal round cross-bar of a ski chair safety device. It is split outwards on one side from the axial hole for its full length so that it may be yieldably forced apart 1) to be seated via the slit by the axial hole on the safety bar cross-bar, and 2) to receive in the slit the free ends of a trail map sheet being wrapped around the cylinder. Adhesive may have been applied to either the surface of the cylinder or the back of the trail map and/or to the slit surfaces to help secure the map permanently in place. This construction and method leaves a virtually seamless finish on the cylinder while at the same time providing for trail information to be displayed on the cylinder. End caps or sheets overlapping the trail map sheet edges may be employed to keep the map edges from fraying and/or to help hold the map sheet in place, particularly where the map sheet is of insufficient length to have ends which can extend into the cylinder slit.

The trail map may be mounted on the cylinder in other ways. For example, the map sheet may be slightly longer than circumference of the cylinder so that its ends may be glued together to hold the map in place. Or the map may be printed on the outside of the cylinder. Or it may be held on by end caps, as mentioned above.

The rotatable elongated member need not be of a smooth cylinder shape. Thus it might be designed to present three flat faces for easier reading of the map. However, flat surfaces when acted on by the wind gusts act as a sail, forcing a safety device down to a closed position and preventing loading and/or possible causing injury to a would-be passenger for the ski lift.

A feature of the invention is that the foam cylinder also can act as a bumper. In the unfortunate event of a sudden wind gust or sudden stop of the chair lift, the chair occupant would be cushioned if he struck the cylinder.

Another feature of the invention is that the rotatable elongated member can provide a substantially larger trail map surface than the exposed surface of trail map carried on the arm or leg by a skier. Thus the chair map can show greater detail or larger area or both.

An advantage of the invention is that it encourages the performance of existing safety practices. This because it encourages chair lift occupants to pull down the safety bar: the pertinent trail information on the safety bar cross-member induces them to pull the safety bar down to its operative position.

Of course, a big advantage of the invention is that it eliminates the dangers inherent with stopping on a ski trail or slope to determine which trail to take. Calamitous collisions between a stopped skier busy reading his map and an unwitting skier up-hill from him will be avoided if the descending skier planned his route ahead of time, that is, on the way up the mountain.

A further advantage of the invention is the reduced risk of frost bite as the skier no longer needs to take off one or both gloves to study a trail map.

Another advantage of the invention is that it makes the skiing trip more satisfying overall because chair lift ride is less boring and more interesting. Having the trail map handy, lift occupants may chose to while away their time studying the trail map during the trip up.

An up-front advantage of the invention is that it educates chair lift occupants to a ski resort's trails. It not only helps keep skiers from getting lost, but it also reduces skier concentrations (and hence greater safety) by encouraging them to explore new trails that they might not otherwise from just chance glimpses of maps displayed at lift stations and in the distracting lodge cafeterias.

A feature of this invention is that all of its advantages are available to the skier without direct cost.

An advantage of the invention for all mankind is its favorable impact on the environment. Utilization of the invention reduces the amount of printing ski resorts do for their paper trail maps. It also reduces the litter found throughout ski resorts from maps blown out of skier's hands, or thrown away after being torn by users or degraded by the weather.

BRIEF DESCRIPTION OF THE DRAWINGS OF A PREFERRED EMBODIMENT

These and other objects, features and advantages of the invention will become apparent from a reading of the following detailed description of a preferred embodiment of the the invention, when considered in conjunction with the following drawings wherein.

DETAILED DESCRIPTION OF PREFERRED EMBODIMENTS OF THE INVENTION

Figure 1:
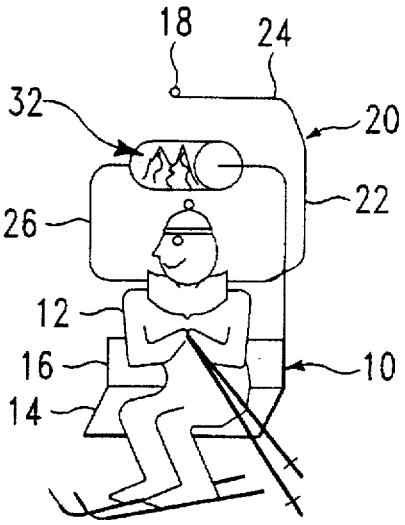
FIG. 1 is a diagrammatic view of a chair lift shortly after the skier has been loaded but before he has pulled down the safety bar bearing a trail map according to the invention.
Figure 2:
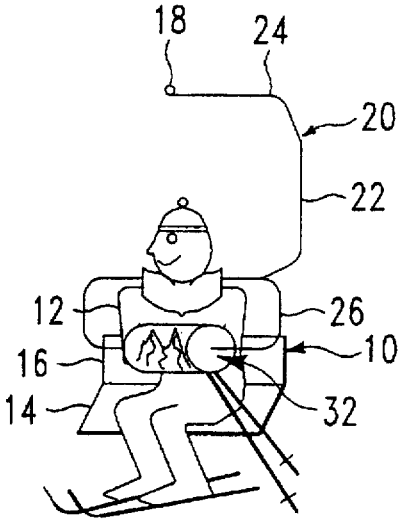
FIG. 2 is a diagrammatic view of the same chair but after the safety bar has been pulled down by the skier and the trail map placed in front of him for easy reading.

Referring now particularly to the drawings, there is shown in FIGS. 1 and 2 a chair lift of the type wherein the invention can readily be embodied as by retrofit. A chair generally indicated by the numeral 10, is shown as belong loaded with a skier 12 resting on a seat 14 and against a back 16. The chair 10 is mounted on a lift cable 18 by means of an arm generally indicated by the numeral 20. The arm 20 includes a vertical portion 22 fixed at lets lower end to the chair 10 in conventional fashion and a horizontal portion 24 fixed at one end to the upper end of the vertical portion 22 and on its free end to the lift cable 18 in conventional fashion accommodating to and for movement of the chair 10.

A conventional bail-shaped safety guard generally indicated by the numeral 26 is pivotally mounted at its bottom end as seen in FIG. 1 and at its rearward end as seen in FIG. 2, upon the back of the chair 10 or on the arm 20, for up and down swinging movement of its top or forward end or round crossbar 28. In its up and rearward movement, the rearward movement of the cross-bar 28 is limited to an over-center position in which it is retained by gravity, by a suitable arm or stop (not shown) engaging the arm 20 or the chair 10. In lets forward and downward movement, the downward movement of the cross-bar 28 is limited to a horizontal position in which it is retained by a suitable arm or stop (not shown) engaging the arm 20 or the chair 10.

According to the invention, a trail map generally indicated by the numeral 30 is rotatably mounted on the safety guard cross-bar 28. The trail map corresponds to the normal trail maps of a ski area, but may be particularized to the trails served by the specific ski lift and to the useful area available on the chair 10. Applicant's invention maximizes the available area on a chair, permitting use of a smaller scale to depict the trail area in larger detail. A smaller scale facilitates reading under outdoor conditions.

Figure 3:
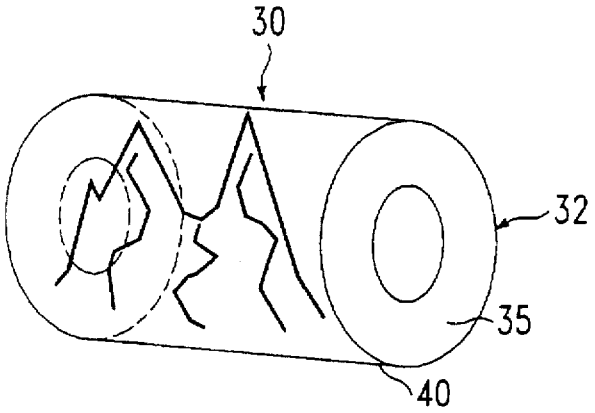
FIG. 3 is an enlarged diagrammatic view of the rotatable elongated-member or cylinder mounted trail map of FIGS. 1 and 2.
Figure 4:
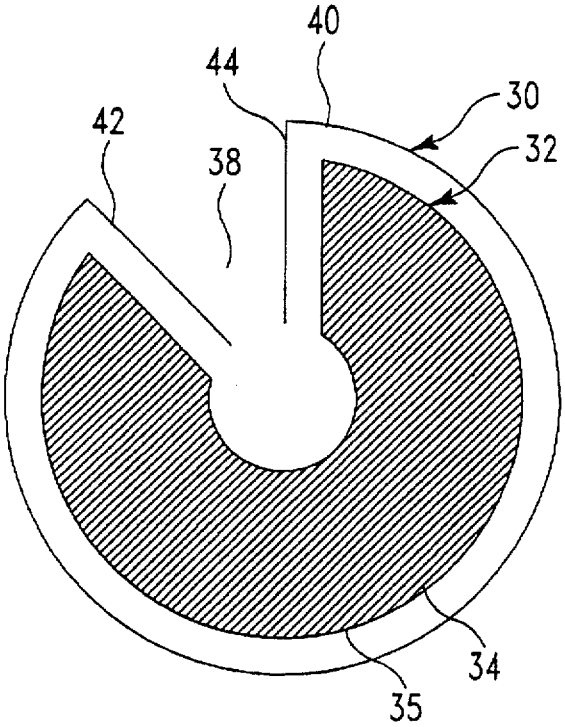
FIG. 4 is a further enlarged end view of the cylinder of FIG. 3, but with it pulled apart at a split to allow insertion of the ends of a trail map therein before release for reclosure and securing of the map thereon.

Applicant maximizes the available area for a trail map by mounting it on a rotatable elongated member or cylinder or drum of a yieldable material such as polyethelene foam (styrofoam) or the like and generally indicated by the numeral 32. As best seen in FIGS. 3 and 4, the cylinder 32 includes an outside surface 34 on a solid core portion 35, an internal axial extending hole 36 and a radial extending slit 38. The slit 38 is opened by conventional means such as pulling apart by hands or by forcing the slit down onto the cross-bar, to seat the cylinder 32 via its axial extending hole 36 on the round cross-bar 28. While conventional washers (not shown) may be employed on the cross-bar beyond each end of the cylinder to keep the cylinder located centrally on the cross-bar 28, it is generally preferred that the cylinder be slidable axially on the crossbar 28 to enable map viewing by any of the occupants of a ski chair.

The trail map 30 includes a sheet 40 having upper and lower ends 42 and 44 respectively. ((The sheet 40 may be of a clear plastic such as LEXAN (General Electric trademark) (a polycarbonate) on which the map is silk screened.)) The ends 42 and 44 are secured in the cylinder slit 38 which is forced apart to receive them and then allowed to reclose to hold the sheet 40 firmly in place on the cylinder 32. Glue may also be employed to hold the sheet 40 on the cylinder: if the trail sheet is long, the overlapping ends may be glued together; if the trail sheet is short, the trail sheet may be glued onto the cylinder instead of using end caps. Trail maps may also be imprinted directly on the surface of the cylinder. Clear plastic may be placed over the trail maps to protect them. The map 30 and its sheet 40 might also be laminated between two plastic sheets to protect them from the elements.

Figure 6:
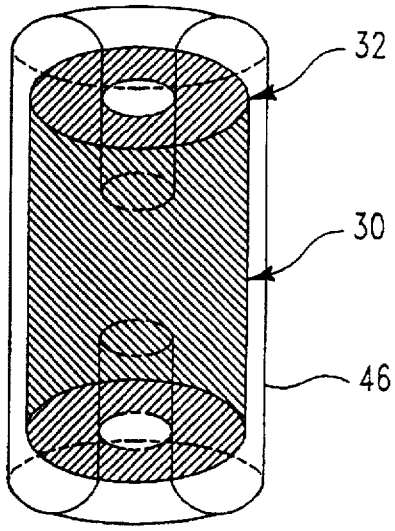
FIG. 6 is a diagrammatic view in perspective showing the use of an overlying clear plastic to protect the trail map and cylinder.

The axial extending hole 36 may be off-center to cause the cylinder to have a normal rotational home position. Thus it might be formed closer to the bottom of the cylinder as shown in FIG. 4, to cause the opposite portion of the cylinder to hang downwards to protect the slit 38 from infiltration by the elements. On the other hand it might be formed closer to the slit side of the cylinder so that the slit 38 is normally upwards and the top of the trail map disposed so as to be automatically first seen by a would-be reader. In such a design, the trail map itself might be covered with a clear plastic 46, such as LEXAN, to protect the slit 38 as shown in FIG. 6. The hole 36 might also be so located as to provide the proper give to the cylinder for opening and closing the slit 38.

Figure 5:
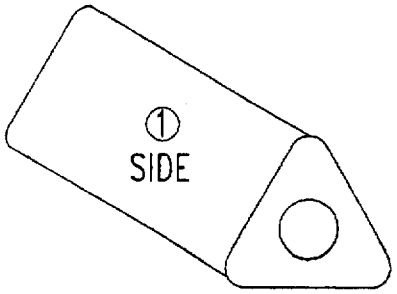
FIG. 5 is a diagrammatic view in perspective of another embodiment of the rotatable elongated-member for mounting a trail map, here a three-sided one for presenting a trail map in three flat faces.

FIG. 5 shows a three-sided rotatable elongated element. The three sides provide flat areas for reading the trail map. The element would be suitably split for the various mounting purposes. Any number of sides may be employed.

Figure 7:
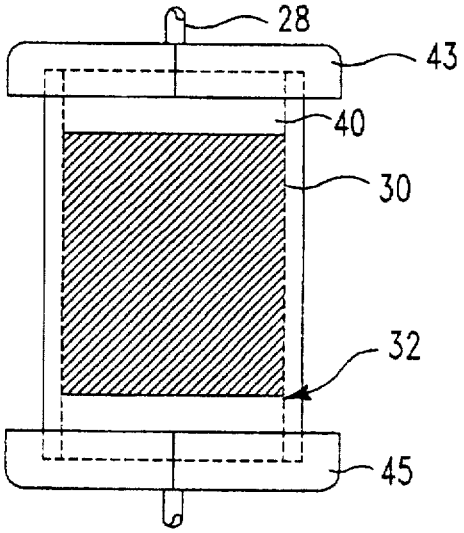
FIG. 7 is a front view showing diagrammatically with respect to a cylinder, a trail map on sheeting of the same width as the cylinder and the use of protecting end caps.

FIG. 7 shows a trail map 30 on sheeting 40 of the same width as the cylinder 32. End caps 43 and 45 cover the ends of the cylinder 32 and sides of the sheet 40. The end caps 43 and 45 may be formed of cups (of polypropylene or the like) center punched with a hole to accommodate the diameter of the crossbar 28 and radially slit outward to enable their yielding placement on the crossbar.

Figure 8:
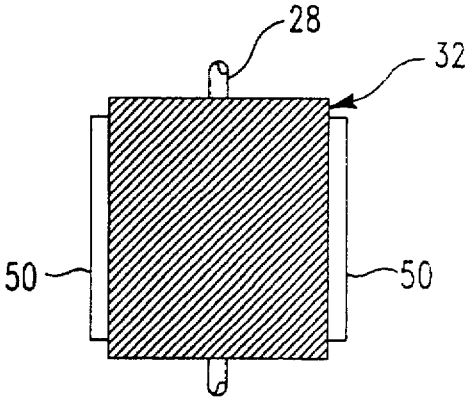
FIG. 8 is front view showing diagrammatically with respect to a cylinder, a trail map on sheeting of less width than the cylinder.

FIG. 8 shows providing a clear sheet 46 extending beyond the ends of the cylinder 32 to protect it.

It can be seen that the present invention affords a virtually standard display area of a typical ski resort map, is inert to the elements, and can be read with considerable safety and convenience by the skier, the skier spinning the cylinder, and moving it laterally if necessary to get it in front of him, with gloved hands. Any and all skiers riding up a chair lift can benefit from the invention without advanced planning, hassle, danger or the cumbersome exercise of getting to the map. The trail map is attached to the horizontal section of the safety bar where it can be readily read by all occupants of a chair. The map can be horizontally printed indirectly or directly on the circumference of the cylinder. To read the map in full, a skier merely spins the cylinder using his or her gloved hand.

It will be appreciated that the principles of the invention may be applied by those skilled in the art to other products and methods. It is desired therefore to be limited only by the scope or spirit of the appended claims.

What is claimed is:

1. In a ski lift chair having a safety bar swung down from overhead after a gloved skier has been loaded onto the chair to a position disposing its cross-bar in front of the now seated skier, an elongated element mounted on the cross-bar and freely rotatable thereon by the gloved hand of the skier and having an axially extending surface, and a map showing ski trails heading downhill from near the top of the particular ski lift located on the outside of the elongated and rotatable element axially extending surface, wherein the elongated and rotatable element is a cylinder, wherein the cylinder is a solid.

2. A ski lift chair according to claim 1, wherein the solid is a yieldable material.

3. A ski lift chair according to claim 2, wherein the yieldable material is a foam.

4. A ski lift chair according to claim 3, wherein the cross-bar is round, and an axial hole larger than the diameter of the cross-bar is formed in the foam and received on the cross-bar.

5. A ski lift chair according to claim 4, wherein the axial hole is eccentrically located in the foam.

6. A ski lift chair according to claim 4, wherein the foam is slit from the axial hole to the perimeter of the cylinder.

7. A ski lift chair according to claim 6, wherein the axial hole is located off-center on the slit side of the cylinder.

8. A ski lift chair according to claim 6, wherein the map on the outside of the slit foam cylinder axially extending surface is on a separate sheet of greater length than the circumference of the cylinder, and the ends of the extra-length sheet are tucked into and held by the slit.

9. A ski lift chair according to claim 8, wherein the ends of the sheet are of extra width and strength, and the sheet is of greater width than the cylinder.

10. A ski lift chair according to claim 1, wherein the map on the outside of the elongated and rotatable element axially extending surface is on a separate sheet secured to the outside of the element.

11. A ski lift chair according to claim 1, wherein the map is printed directly on the elongated and rotatable element axially extending surface.

12. A ski lift chair according to claim 1, wherein the map is covered with a clear plastic sheet secured to the elongated and rotatable element.

13. A ski lift chair according to claim 12, wherein sheet material is mounted on the sides of the elongated and rotatable element.

14. A ski lift chair according to claim 1, wherein the elongated and rotatable element is eccentrically mounted.

15. A ski lift chair according to claim 1, wherein the elongated element is movable laterally on the cross bar.

16. In a ski lift chair having a safety bar swung down from overhead after a gloved skier has been loaded onto the chair to a position disposing its cross-bar in front of the now seated skier, an elongated element mounted on the cross-bar and freely rotatable thereon by the gloved hang of the skier and axially extending surface, and a map showing ski trails heading downhill from near the top of the particular ski lift located on the outside of the elongated and rotatable element axially extending surface, wherein the elongated and rotatable element is a solid and has flat faces on its axially extending surface.

17. A ski lift chair according to claim 1, wherein the number of flat faces numbers three.

18. In a method for placing a trail map sheet longer than the periphery of a slit solid foam cylinder rotatable on the round cross-bar of the safety guard of a ski lift chair that is swung down from overhead after a gloved skier has been loaded onto the chair to a position disposing the cross-bar in front of a then seated skier where he may view the trail map and rotate it, placing the sheet on the cylinder and so that its ends overlap the slit, spreading the slit apart from a normally closed position, inserting the ends of the trail map sheet into the slit, and allowing the slit to reclose and secure the trail map sheet in place on the cylinder.

* * * * *